United States Patent [19]

Lisiecki

[11] Patent Number: 4,842,188

[45] Date of Patent: Jun. 27, 1989

[54] TWO-PIECE FLAT TOP CONTAINER

[75] Inventor: Robert E. Lisiecki, West Bloomfield, Mich.

[73] Assignee: Elopak Systems A.G., Glattbrugg, Switzerland

[21] Appl. No.: 225,382

[22] Filed: Jul. 28, 1988

[51] Int. Cl.[4] ..... B65D 5/54

[52] U.S. Cl. ..... 229/123.3; 206/620; 206/621; 206/623; 206/628; 229/125.33

[58] Field of Search ..... 229/125.19, 125.33, 229/125.35, 123.2, 123.3; 206/621, 623, 624, 628, 634, 620

[56] References Cited

U.S. PATENT DOCUMENTS

| | | | |
|---|---|---|---|
| 2,474,523 | 6/1949 | Guyer | 206/623 |
| 2,562,579 | 7/1951 | Ringler | 229/125.19 |
| 2,758,775 | 8/1956 | Moore | 206/621 |
| 3,162,100 | 12/1964 | Rein et al. | 229/125.19 |
| 3,958,747 | 5/1976 | Chipp et al. | 206/621 |
| 4,397,415 | 8/1983 | Lisiecki | 206/621 |
| 4,702,407 | 10/1987 | Lisieki | 206/624 |
| 4,801,080 | 1/1989 | Spengler | 229/125.19 |

FOREIGN PATENT DOCUMENTS

| | | | |
|---|---|---|---|
| 711242 | 6/1954 | United Kingdom | 229/125.19 |
| 2027677 | 2/1980 | United Kingdom | 206/624 |

*Primary Examiner*—Gary Elkins

*Attorney, Agent, or Firm*—John P. Moran

[57] ABSTRACT

A flat top, thermoplastic coated, paperboard container including a separate cover panel and fold-out segments having weakened lines formed thereon such that the top may be using the fold-out segments as lift tabs and breaking the weakened lines at the front and progressively breaking the weakened lines along the sides upon peeling back and fold-out segments and the cover panel, to provide access to the contents. Provisions are included for protecting the weakened lines to prevent leakage.

15 Claims, 4 Drawing Sheets

FIG.1
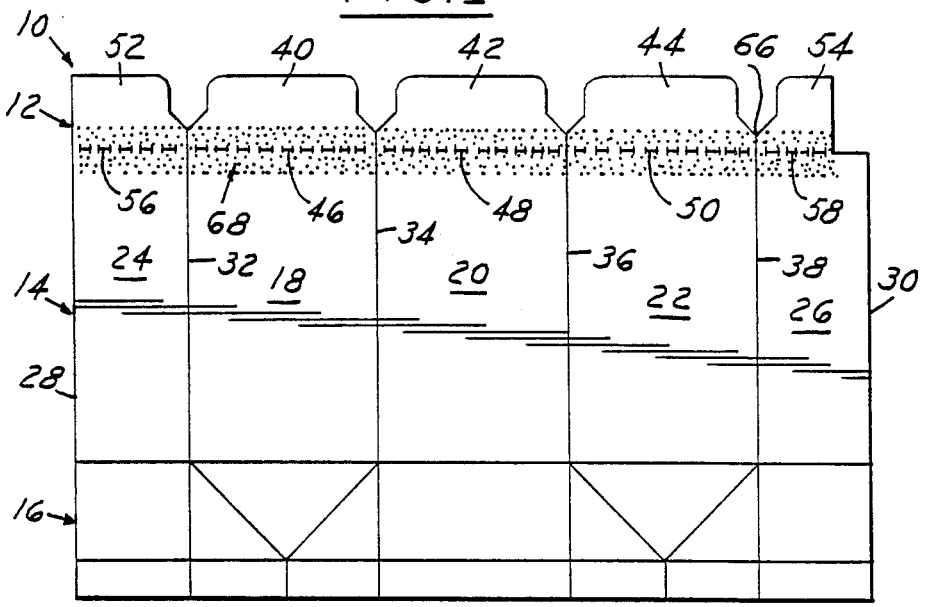
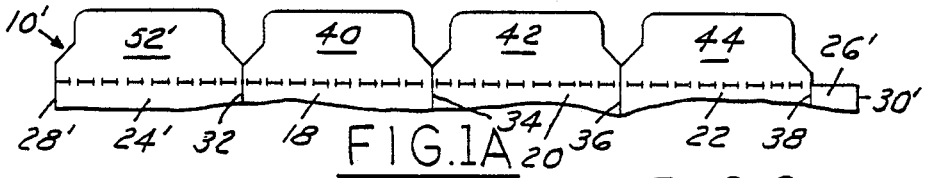
FIG.1A
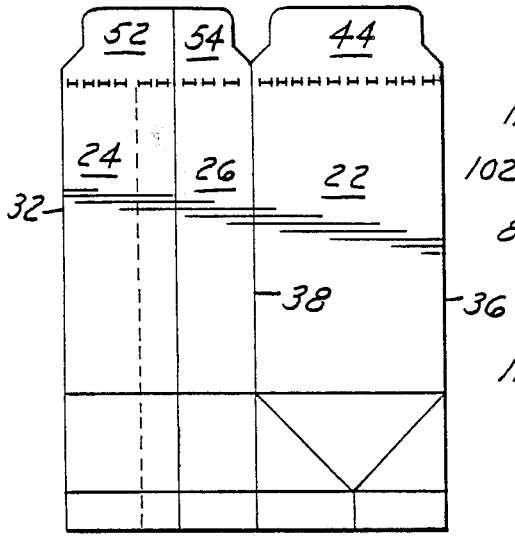
FIG.2
FIG.3
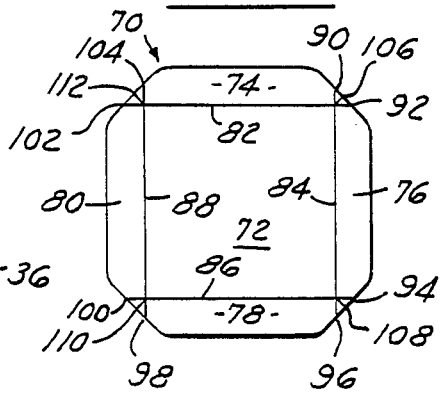

TWO-PIECE FLAT TOP CONTAINER

TECHNICAL FIELD

This invention relates generally to thermoplastic coated paperboard containers and, more particularly, to a blank and a container including a separate top end closure of an improved construction.

BACKGROUND ART

Containers for beverages such as milk, cream, other dairy products, juices, and the like, are conventionally constructed from the thermoplastic coated paperboard. Typically, these containers include a top end closure with a folded roof structure adaptable to providing a readily available pouring spout when the contents of the container are to be dispensed.

Coated paperboard blanks for constructing such a container are made on converting machines similar to those disclosed by Monroe et al U.S. Pat. No. 2,682,208 and Earp U.S. Pat. No. 3,731,600. After construction, the blanks are processed by forming, filling and sealing machines, such as those disclosed by Monroe et al U.S. Pat. No. 3,303,761, Allen U.S. Pat. No. 3,918,236, Egleston U.S. Pat. No. 3,398,659 or Young U.S. Pat. No. 4,193,833, to produce the formed, filled and sealed containers of the type referred to above and shown and described in Egleston et al U.S. Pat. No. 3,270,940, or Lisiecki U.S. Pat. No. 4,422,570.

While this type of container has been generally satisfactory for liquid products, it is desirable to utilize a similar square or rectangular thermoplastic coated paperboard container for frozen juices with a modified top closure arrangement which is adaptable to being fully opened, in lieu of using a conventional cylindrical paperboard container with a removable metal or solid plastic top cover. Such a modified top closure arrangement is desirable also for containing and providing access to "spoonable" products, such as yogurt and puddings. One example of a satisfactory top closure of a substantially fully openable type is shown and described in Lisiecki U.S. Pat. No. 4,397,415. A further example of a satisfactory to closure of a completely fully openable type is shown and described in Lisiecki U.S. Pat. No. 4,702,407.

DISCLOSURE OF INVENTION

A general object of the invention is to provide a thermoplastic coated paperboard container including improved top closure means for providing the above mentioned desirable fully openable feature for particular products.

Another object of the invention is to provide an improved thermoplastic coated paperboard container suitable for being filled with a juice concentrate and then frozen, or with foodstuffs of a somewhat solid consistency.

A further object of the invention is to provide a square or rectangular paperboard container including an improved, conveniently fully openable flat top closure arrangement.

A still further object of the invention is to provide a flat top container including lift flaps having a perforated portion covered with a foil patch, a thermoplastic film, or a thermoplastic hot melt. Alternately, the perforated portion may be "sandwiched" between two liquid proof films.

Still another object of the invention is to provide alternate embodiments of a flat top container wherein the cover panel is one of a full panel top for maximum "billboard" effect.

Still another object of the invention is to provide a separate top cover with provisions for overlapping out-turned lift tabs formed on the container proper.

Other objects and advantages of the invention will become more apparent when reference is made to the following drawings and related description.

BRIEF DESCRIPTION OF DRAWINGS

FIG. 1 is a plan view of the inside surface of a coated paperboard container blank used to construct a container having a top end closure in accordance with the present invention;

FIG. 1A is a fragmentary plan view of an alternate embodiment of the FIG. 1 structure.

FIG. 2 is a plan view of the outside surface of a blank after it is side seamed from the blank illustrated in FIG. 1;

FIG. 3 is a top view of a separate top cover for the container formed from the FIGS. 1 and 2 blank;

BEST MODE OF CARRYING OUT THE INVENTION

Figure 4:
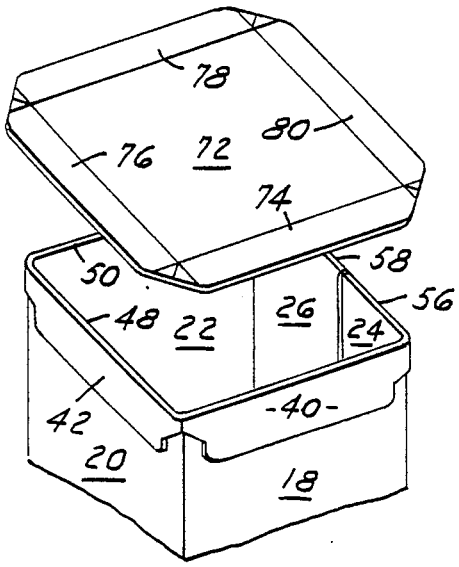
FIGS. 4 and 5 are enlarged fragmentary perspective views illustrating sequentially the steps involved in forming the flat top end closure.
Figure 5:
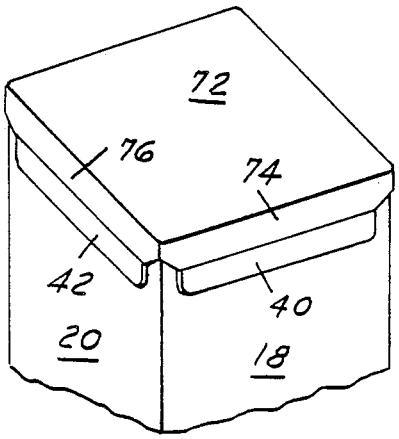
Figure 6:
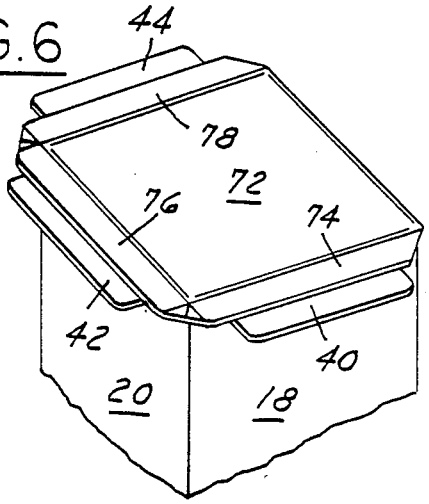
FIGS. 6 and 7 are a fragmentary perspective views showing the container of FIG. 5 after the top closure has been sealed closed and then opened.
Figure 7:
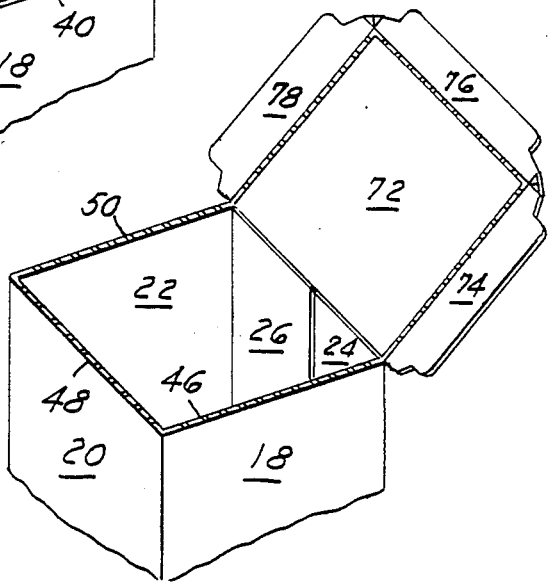

Referring now to the drawings in greater detail, FIG. 1 illustrates a container blank 10 formed in accordance with the principles of the present invention. The container blank 10 is generally divided into three sections including a top fold-over portion 12, a body portion 14, and a conventional flat bottom end closure 16. The latter may be any suitable end closure arrangement and is not a part of this invention.

The body portion 14 comprises a plurality of integrally connected body panels, namely, three full width panels 18, 20 and 22, and a two-partial width panels 24 and 26 connected to the panels 18 and 22, respectively. The container blank 10 is defined on its longitudinal sides by edges 28 and 30. The body panels 24/18, 18/20, 20/22 and 22/26 are connected by vertical score lines 32, 34, 36 and 38. It should be apparent that the body panels may be equal in width and hence, adaptable to forming a square cross-section container, or may be formed such that one pair of alternate body panels is wider than the other pair and, hence, adaptable to forming a rectangular cross-section container.

The top fold-over portion 12 comprises three panel segments 40, 42 and 44 connected by perforated lines 46, 48 and 50 to the tops of the body panels 18, 20 and 22. Edge panels 52 and 54 are connected by perforated lines 56 and 58, respectively, to the tops of the partial width panels 24 and 26.

A layer 68 of a suitable material, such as a thermoplastic hot melt, or a strip of either aluminum foil or thermoplastic film, is secured to all the inside surfaces adjacent the perforated lines 56, 46, 48, 50 and 58. Alternately, the perforated lines may be formed in the paperboard layer only, and then covered by the conventional outer and inner polyethylene films.

Referring now to FIG. 3, there is illustrated a separate top end cover 70 including a central portion 72 with four side segments 74, 76, 78 and 80 connected thereto by respective score lines 82, 84, 86, and 88. Small triangular segment pairs 90/92, 94/96, 98/100 and 102/104 are formed between the side segments 79/76, 76/78, 78/80 and 80/74, respectively, connected thereto be extensions of the score lines 82, 84, 86 and 88. The triangular segment pairs 90/92, 94/96, 98/100 and 102/104 are either formed as one continuous triangle, or, alternatively, connected to each other by score lines 106, 108, 110 and 112, respectively.

The container blank 10 illustrated in FIG. 1 is first formed into a side seamed blank as shown in FIG. 2 by rotating the body panels 22 and 26 as a unit about the vertical score line 36, and having the inside surfaces of the body panel 22 come into contact with the inside surface of the body panel 20, with the vertical score line 38 positioned next to the vertical score line 34, and with the inside surface of the panel 26 contacting the inside surface of the body panel 18 adjacent the vertical score line 34. The body panel 24 is then rotated about the vertical score line 32 o bring its inside surface into contact with the inside surface of the body panel 18, and overlapping the outside surface of the panel 26. The various members of a bottom end closure will make similar movements. Insofar as the top fold-over portion 12 is concerned, the edge panel 44 overlies the edge panel 42, the edge panel 54 overlies a portion of the edge panel 40, and the edge panel 52 overlies the edge panels 40. The container blank 10 is then sealed where the inside area of the body panel 24 comes into contact with the outside surfaces of the panel 26. Note that the fold-over segment 54 is narrower than the segment 52, such that they abut against each other, but do not overlap.

In the FIG. 1 structure, if desired, in the formation of the side seam blank the panel 26 could be sealed to the outside surface of the panel 24, rather than to the inner surface thereof as described above. Additionally, if desired, the blank may be formed as shown at 10' in FIG. 1A, wherein there are four full body panels, panel 24' being a full width panel, rather than the partial width panel 24 of FIG. 1, and panel 26' being a side seam flap for conventional corner lapping, rather than the partial width center lapping panel 26 of FIG. 1. The panel segment 54 of FIG. 1 is eliminated and a full width panel segment 52' replaces the partial width segment 52 of FIG. 1.

Accordingly, after the side seam blank is opened up into a squared condition, as shown in FIG. 4, the edge panels 40, 42, 44 and 52/54 are forced outwardly and downwardly about the respective perforated lines 46, 48, 50 and 56/58, after which the end cover 70 is placed on the edges formed by the perforated lines, followed by the bending of the side segments 74, 76, 78 and 80 about the score lines 82, 84, 86 and 88 onto the panel segments 40, 42, 44 and 52/54.

If desired, the edge panels 40, 42, 44, 52 and 54 may be folded about the respective perforated lines 46, 48, 50, 66 and 58 onto the respective body panels 18, 20, 22, 24 and 26 while the blank 10 is still in its flat state shown in FIG. 1. This operation would then be followed bY the formation of the side seamed blank of FIG. 2.

The sealing of the interrelated elements of the top fold-over portions is then accomplished by conventional means, such as a sonic or high frequency vibration sealing means. The sealing of the various top end closure elements may also be accomplished by other means, such as gas heat, if desired. FIG. 4 illustrates the top end closure 12 structure once the sealing thereof has been effected.

In opening the carton, three panel segments 40, 42 and 44 are first lifted into a horizontal attitude, thereby lifting the side segments 74, 76 and 78. The opening forces which follow are such that the weakened lines are in tension and, therefore, they tear cleanly without delamination, as the tabs 42, 40 and 44 are raised about the lines 88 and 56/58.

Referring now to FIGS. 8–14, there is illustrated an alternate embodiment wherein the body portion 14 and bottom closure 16 are the same as for the FIGS. 1–7 arrangement, but wherein the panel segments 40, 42, 44 and 52/54 are replaced by two adjacent partial segments 114 and 116 The latter segments are connected by perforated lines 118 and 120, respectively, to adjacent body panels 18 and 20. The segments 114 and 116 are separated from each other by a weakened line 122.

A separate top end cover 124 includes a central portion 126, with four side segments 128, 130, 132 and 134 connected thereto by respective score lines 136, 138, 140 and 142. Small triangular segment pairs 144/146, 148/150, 152/154 and 156/158 are formed between the side segments 128/130, 130/132, 132/134 and 134/128, respectively, connected thereto by extensions of the score lines 136, 138, 140 and 142. The triangular segment pairs 144/146, 148/150, 152/154 and 156/158 may be connected to each other by score lines 160, 162, 164 and 166, respectively A score line 168 extends from the approximate midpoint of the score line 136 to the approximate midpoint of the score line 138. A first perforated line 170 extends from the approximate midpoint of the score line 140 to the juncture of the score lines 138 and 168. A second perforated line 172 extends from the approximate midpoint of the score line 142 to the juncture of the score lines 136 and 168. A further perforated line 174 is formed across the width of the side segment 132 from the juncture of the score line 140 and the perforated line 170. A similar perforated line 176 is formed across the width of the side segment 134 from the juncture of the score line 142 and the perforated line 172.

Figure 8:
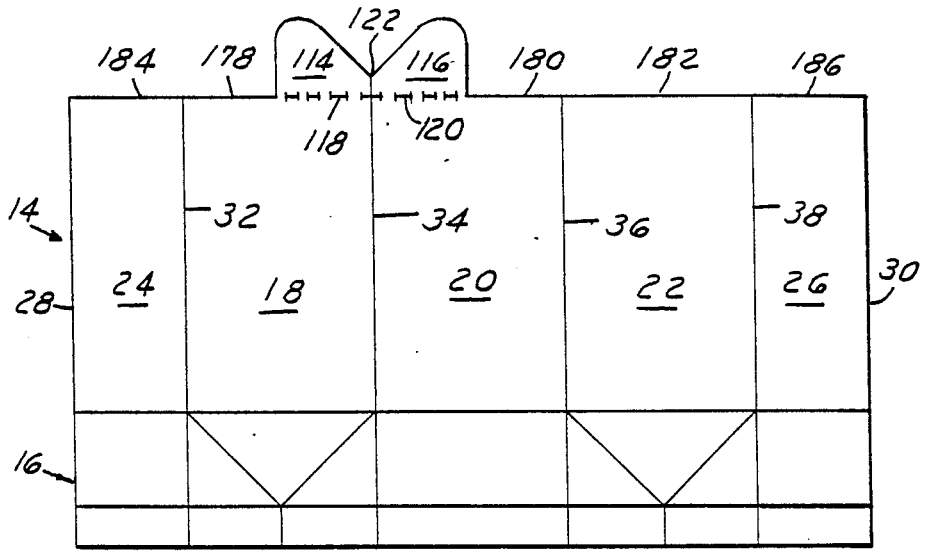
FIG. 8 is a fragmentary layout view of the inside surface of an alternate embodiment blank from which a container embodying the invention may be erected.
Figure 9:
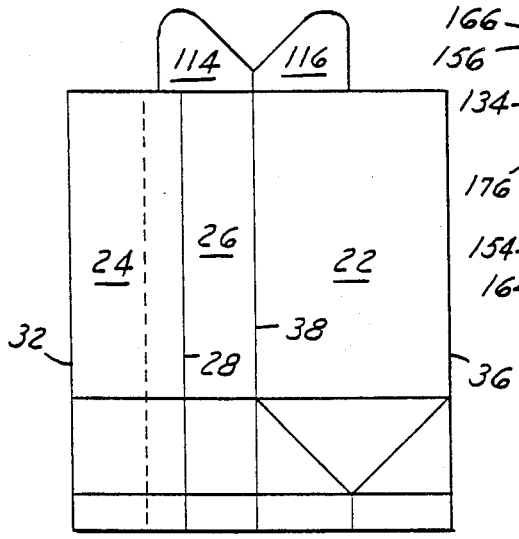
FIGS. 9 and 10 are views of the alternate embodiment comparable to the FIGS. 2 and 3 of the preferred embodiment.
Figure 10:
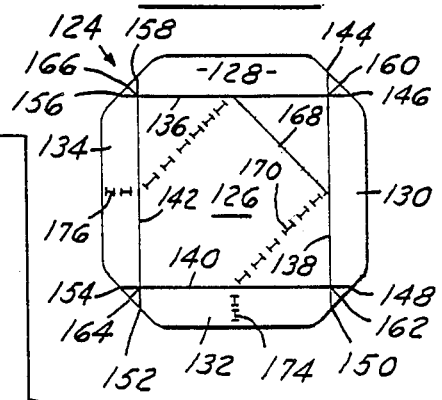
Figure 11:
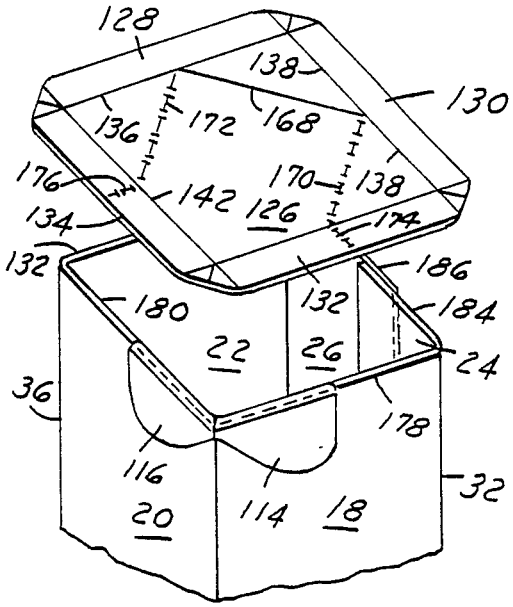
FIGS. 11–14 are views of the alternate embodiment comparable to the FIGS. 4–7 of the preferred embodiment.
Figure 12:
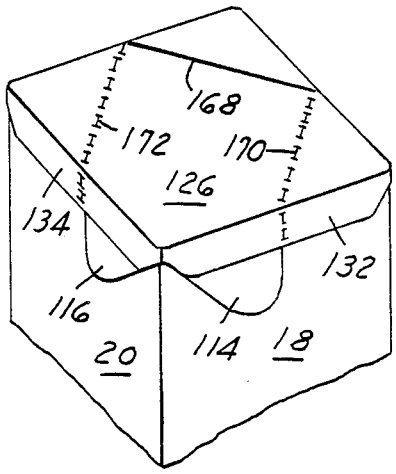

The container blank illustrated in FIG. 8 is formed into the side seamed blank shown in FIG. 9 in the said manner as the blank 10 of FIG. 1 is formed into the side seamed blank of FIG. 2. Thereafter, the side seamed blank is opened up into a squared condition and the panel segments 114 and 116 are folded outwardly and downwardly onto the body panels 18 and 20, respectively, as shown in FIG. 11. The end cover 124 is then placed on the edges formed by the perforated lines 118 and 120, as well as on the co-planar free upper edges 178, 180, 182, 184 and 186 of the respective body panels 18, 20, 22, 24 and 26, as may be noted from FIG. 11.

Once the end cover 124 is so placed, its side segments 128, 130, 132 and 134 are folded downwardly causing the segments 128 and 130 to engage the top edge portions of the body panels 22 and 26/24, and the segments 132 and 134 to engage the respective folded-over segments 114 and 116 and their respective adjacent top edge portions of the body panels 18 and 20 (FIG. 12), whereupon they are sealed by conventional means.

Figure 13:
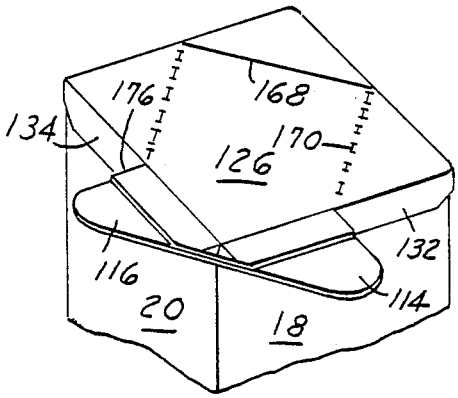
Figure 14:
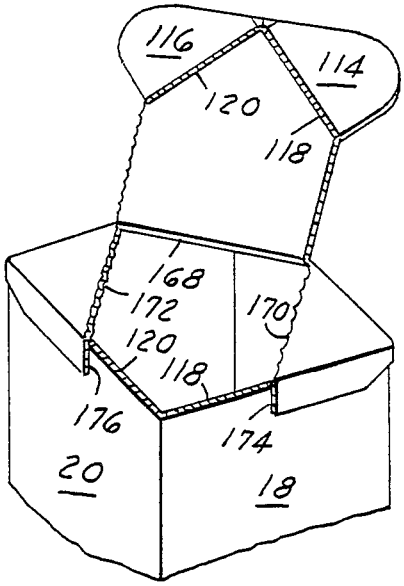

In opening the carton, the folded-over segments 114 and 116 serve as lift tabs, causing adjacent halves of the side segments 132 and 134 to break at the perforated lines 174 and 176, respectively, as shown in FIG. 13. Thereafter, further lifting of the lift tabs 114 and 116 causes the central portion 126 to tear along the perforated lines 170 and 172, terminating at the score line 168, serving as a hinge as shown in FIG. 14.

INDUSTRIAL APPLICABILITY

It should be apparent that the invention provides a novel and efficient thermoplastic coated paperboard carton which is ideally suited for being filled with a frozen concentrate, such as orange juice, or with a spoonable product, such as yogurt and puddings, for example, and sealed for distribution through the marketing system, and capable of being readily and easily opened by the consumer.

It is believed to be important to note that if the perforated lines 46, 48, 50, 56 and 58 were formed first on the central paperboard layer, and the conventional thermoplastic coating, such as polyethylene, added thereafter, it would be possible to omit the layer 68 from the blank of FIG. 1. Furthermore, in lieu of the perforated lines 46, 48 and 50 a partial continuous cut made on the outside surface through the outer half of the paperboard thickness could be utilized, also permitting the omission of the inner extra layer 68 described above.

While two embodiments of the invention have been shown and described, other modifications thereof are possible within the scope of the following claims.

The embodiments of the invention in which an exclusive property or privilege is claimed are defined as follows:

1. A thermoplastic coated two-piece container comprising:

(a) four body panels;

(b) a plurality of top fold-down edge panels integrally connected to the top ends of selected body panels and folded outwardly and downwardly onto said selected body panels to serve as lift tabs;

(c) a separate top cover panel mounted on the top edges said body panels and including a central portion and four side edge fold-down panel segments folded onto and sealed to the underlying panel surfaces;

(d) a plurality of weakened lines formed on said plurality of top fold-down edge panels where connected to said body panels and adapted to being broken upon the lifting and raising of said lift tabs.

2. The container described in claim 1, and a layer of one of aluminum foil, thermoplastic film or hot melt covering said weakened lines on the inside surfaces of said two-piece container.

3. The container described in claim 1, wherein said four body panels consist of three full width panels and two overlapping partial width panels, and said plurality of top fold-down edge panels consists of three full width panels and two partial width panels.

4. The container described in claim 1, wherein said four body panels consist of four full width panels and one side seamed flap in overlapping relationship with one of said four full width panels, and said plurality of top fold-down edge panels consists of four full width panels.

5. The container described in claim 1, wherein said plurality of top fold-down edge panels consists of two partial width panels connected to portions of two said four body panels by said perforated lines.

6. The container described in claim 1, and corner segments formed and sealed between adjacent edge fold-down panel segments of said separate top cover panel.

7. The container described in claim 1, and a plurality of weakened lines formed intermediate said plurality of top fold-down edge panels and said four body panels, and consist of perforated lines.

8. The container described in claim 1, and a plurality of weakened lines formed on said separate top cover panel.

9. The container described in claim 9, wherein said weakened lines consist of two parallel perforated lines formed diagonally across said central portion between the approximate center points of respective adjacent top edge fold-down panel segments, and a perforated line formed across the width of each of two top edge fold-down panel segments at adjacent terminations of said parallel perforated lines, dividing each of the two top edge fold-down panel segments in side-by-side segments.

10. The container described in claim 3, wherein said four top edge fold-down panel segments are folded onto and sealed to said three full width panels and two partial width panels.

11. The container described in claim 4, wherein said four top edge fold-down panel segments are folded onto and sealed to said four uull width fold-down edge panels.

12. The container described in claim 5, wherein said four top edge fold-down panel segments are folded onto and sealed to said two partial width top fold-down edge panels and to the remaining exposed top edge portions of said four body panels.

13. A thermoplastic coated two-piece container comprising:

(a) four body panels;

(b) four top fold-down edge panels connected by perforated lines to said four body panels, and folded outwardly and downwardly onto said four body panels to serve as lift tabs; and (c) a separate top cover panel mounted on the perforated lines and including a central portion and four side edge fold-down panel segments folded onto and sealed to said four top fold-down edge panels.

14. A thermoplastic coated two-piece container comprising:

(a) four body panels;

(b) two top fold-down edge panels connected by perforated lines to adjacent portions of two of said four body panels and folded outwardly and downwardly onto said two body panels; and (c) a separate top cover mounted on the two perforated lines and the remaining top edges of said four body panels, and including a central portion and four side edge fold-down panel segments folded onto and sealed to said two top fold-down edge panels and to the remaining exposed top edge portions of said four body panels.

15. The container described in claim 16, and two perforated lines formed diagonally across said central portion between the approximate midpoints of respective adjacent side edge fold-down panel segments, and a perforated line formed across the width of each of two side edge fold-down panel segments at adjacent terminations of said parallel perforated lines, dividing each of the two side edge fold-down panel segments in side-by-side segments.

* * * * *

UNITED STATES PATENT AND TRADEMARK OFFICE

CERTIFICATE OF CORRECTION

PATENT NO. : 4,842,188

DATED : June 27, 1989

INVENTOR(S) : Robert E. Lisiecki

It is certified that error appears in the above-identified patent and that said Letters Patent is hereby corrected as shown below:

Column 6, line 1, after "two" insert therefor --of--.

Column 6, line 14, delete "9" and insert therefor --8--.

Column 6, line 24, delete "top" and insert therefor --side--.

Column 6, line 59, delete "16" and insert therefor --14--.

Signed and Sealed this

Thirtieth Day of October, 1990

*Attest:*

HARRY F. MANBECK, JR.

*Attesting Officer*

*Commissioner of Patents and Trademarks*